US008267556B2

(12) United States Patent
Liu

(10) Patent No.: US 8,267,556 B2
(45) Date of Patent: Sep. 18, 2012

(54) BUCKLE ASSEMBLY AND LAMP USING THE SAME

(75) Inventor: You-Xue Liu, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 246 days.

(21) Appl. No.: 12/878,962

(22) Filed: Sep. 9, 2010

(65) Prior Publication Data

US 2011/0176320 A1 Jul. 21, 2011

(30) Foreign Application Priority Data

Jan. 16, 2010 (CN) ..... 2010 1 0300371

(51) Int. Cl.
*F21S 8/00* (2006.01)

(52) U.S. Cl. ..... 362/427; 24/307; 24/191; 24/544; 292/256.69

(58) Field of Classification Search ..... 362/427; 292/246, 247, 256.69, 252; 24/307, 663, 24/191, 544, 68 E
See application file for complete search history.

(56) References Cited

U.S. PATENT DOCUMENTS 4,326,739 A * 4/1982 Schlueter ..... 292/247
5,732,987 A * 3/1998 Wright et al. ..... 292/113
6,179,350 B1 * 1/2001 Ely et al. ..... 292/113

* cited by examiner

*Primary Examiner* — Evan Dzierzynski
(74) *Attorney, Agent, or Firm* — Altis Law Group, Inc.

(57) ABSTRACT

An exemplary lamp includes a first member, a second member, and buckle assemblies securing the first member on the second member. Each buckle assembly includes a connecting member having an end thereof pivotally connected to the second member, a buckle having an end thereof pivotally connected to an opposite end of the connecting member and having an opposite end thereof clasping the first member to the second member, and a knob. Each buckle assembly has a dead point. When the buckle is flapped towards the connecting member and a pivoted end between the buckle and the connecting member passes through the dead point to get close to the second member, the knob extends through the buckle. Then the knob is rotated along a predetermined direction to press on the buckle, thereby preventing the pivoted end from moving away from the second member.

17 Claims, 5 Drawing Sheets

BUCKLE ASSEMBLY AND LAMP USING THE SAME

BACKGROUND

1. Technical Field

The disclosure generally relates to lamps, and particularly to a lamp with buckle assemblies.

2. Description of Related Art

A conventional lamp generally includes a lamp body having a window through which light emitted from a light source radiates. An envelope covers the window and engages with the lamp body. The envelope includes a convex portion and a flange extending outwards from a peripheral edge of the convex portion. In process of mounting the envelope on the lamp body, a strip is provided to press the flange of the envelope on a periphery of the lamp body, and a large number of screws is used to extend through the strip and the flange of the envelope and engage into the periphery of the lamp body, whereby the envelope and the lamp body are assembled together.

However, mounting and removing of the envelope to and from the lamp body, requires a tool to fasten and remove the screws. Thus, the assembly and disassembly of the envelope are not only time-consuming but also laborious.

What is needed, therefore, is a lamp which can overcome the above-mentioned limitations.

BRIEF DESCRIPTION OF THE DRAWINGS

Many aspects of the present illuminating device can be better understood with reference to the following drawings. The components in the drawings are not necessarily drawn to scale, the emphasis instead being placed upon clearly illustrating the principles of the present illuminating device. Moreover, in the drawings, like reference numerals designate corresponding parts throughout the several views.

DETAILED DESCRIPTION

Figure 1:
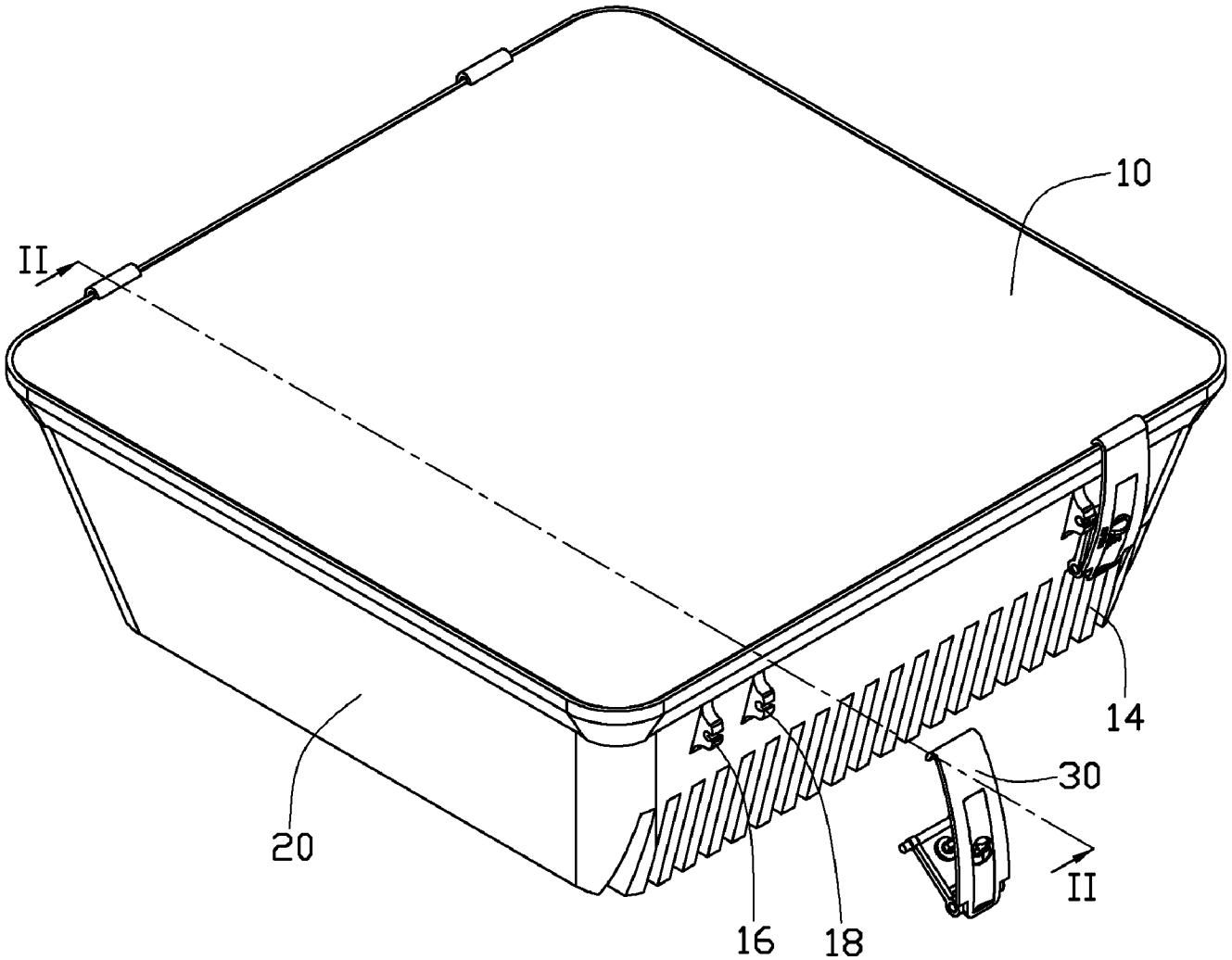
FIG. 1 is an assembled view of a lamp in accordance with an embodiment of the disclosure, wherein a buckle assembly is uninstalled from the lamp.
Figure 2:
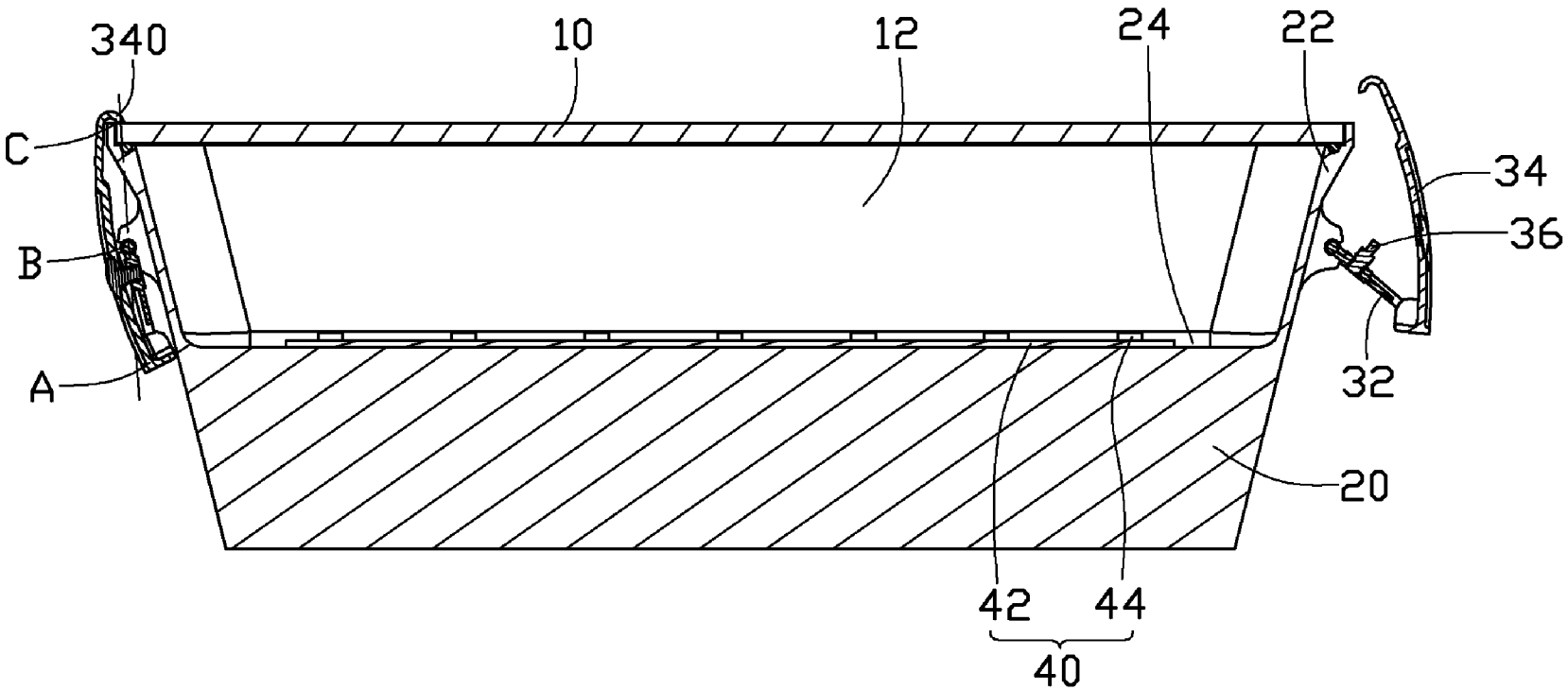
FIG. 2 is a cross-sectional view of the lamp of FIG. 1, taken along line II-II thereof, wherein the buckle assembly is pivotally connected to the lamp and is in an unlocked position.

Referring to FIGS. 1-2, a lamp is illustrated in accordance with an embodiment of the disclosure. The lamp comprises a first member 10, a second member 20, a plurality of buckle assemblies 30 mounted at an outer circumference of the second member 20, and a light source module 40 received in the second member 20. The first member 10 covers a top of the second member 20. The buckle assemblies 30 clasp a circumference of a top of the first member 10 to press the first member 10 on the second member 20. The first member 10 seals the light source module 40 in the second member 20. Light emitted from the light source module 40 projects out of the second member 20 through the first member 10. In this embodiment, the light source module 40 is an LED (light emitting diode) module. In other embodiments, the light source module 40 may be other light source modules, for example, fluorescent tubes. In this embodiment, number of the buckle assemblies 30 is two pairs, and the two pairs of the buckle assemblies 30 are mounted at two opposite sides of the second member 20, respectively.

The first member 10 functions as an envelope for the lamp and may be integrally formed of transparent materials such as glass or plastic. The first member 10 has a rectangular configuration.

The second member 20 has a rectangular and bowl-shaped configuration. The second member 20 comprises a receiving chamber 12 defined in a top thereof to form a circumferential wall 22 and a bottom wall 24 in the receiving chamber 12. The light source module 40 is attached to the bottom wall 24. A plurality of parallel, spaced fins 14 extend downwardly from the bottom wall 24 to dissipate heat generated by the light source module 40 into ambient air. The buckle assemblies 30 are mounted at two opposite sides of the circumferential wall 22. Four pairs of buckle seats 16 are disposed at the opposite sides of the circumferential wall 22. Each of the buckle assemblies 30 corresponds to a pair of buckle seats 16. Each of the buckle seats 16 protrudes out from the circumferential wall 22. Each of the buckle seats 16 is substantially triangular. The buckle seats 16 are substantially perpendicular to the first member 10, and parallel to the fins 14. Each of the buckle seats 16 comprises a cutout 18 defined in an outermost extremity thereof, and the cutouts 18 of each pair of the buckle seats 16 are in alignment with each other. The cutouts 18 face laterally outwardly.

The light source module 40 comprises a printed circuit board 42 attached to the bottom wall 24 of the second member 20 and a plurality of light emitting components 44 mounted on the printed circuit board 42. The light emitting components 44 are LEDs according to the preferred embodiment.

Figure 3:
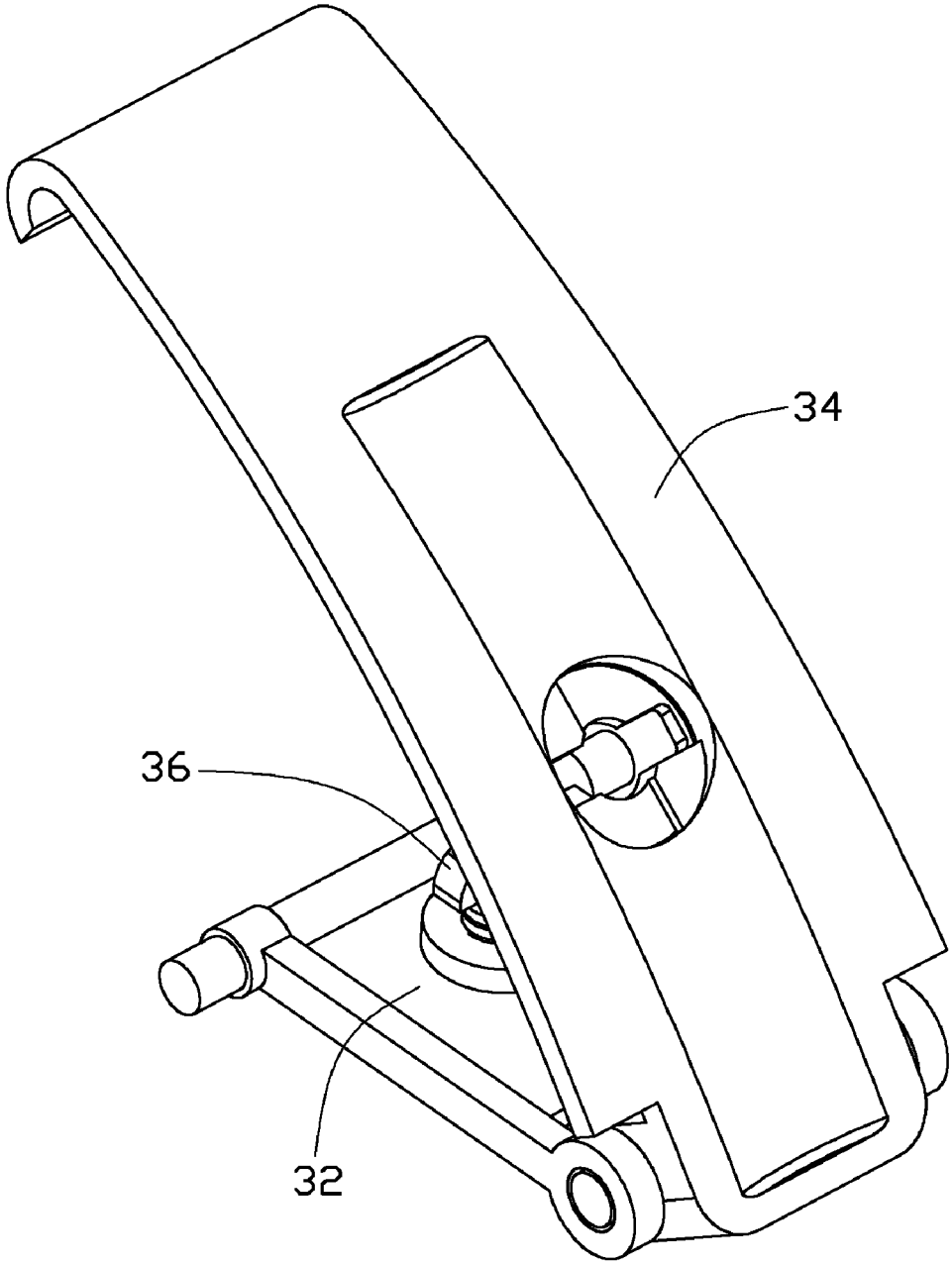
FIG. 3 is an isometric view of the buckle assembly in the unlocked position of the lamp of FIG. 2.
Figure 4:
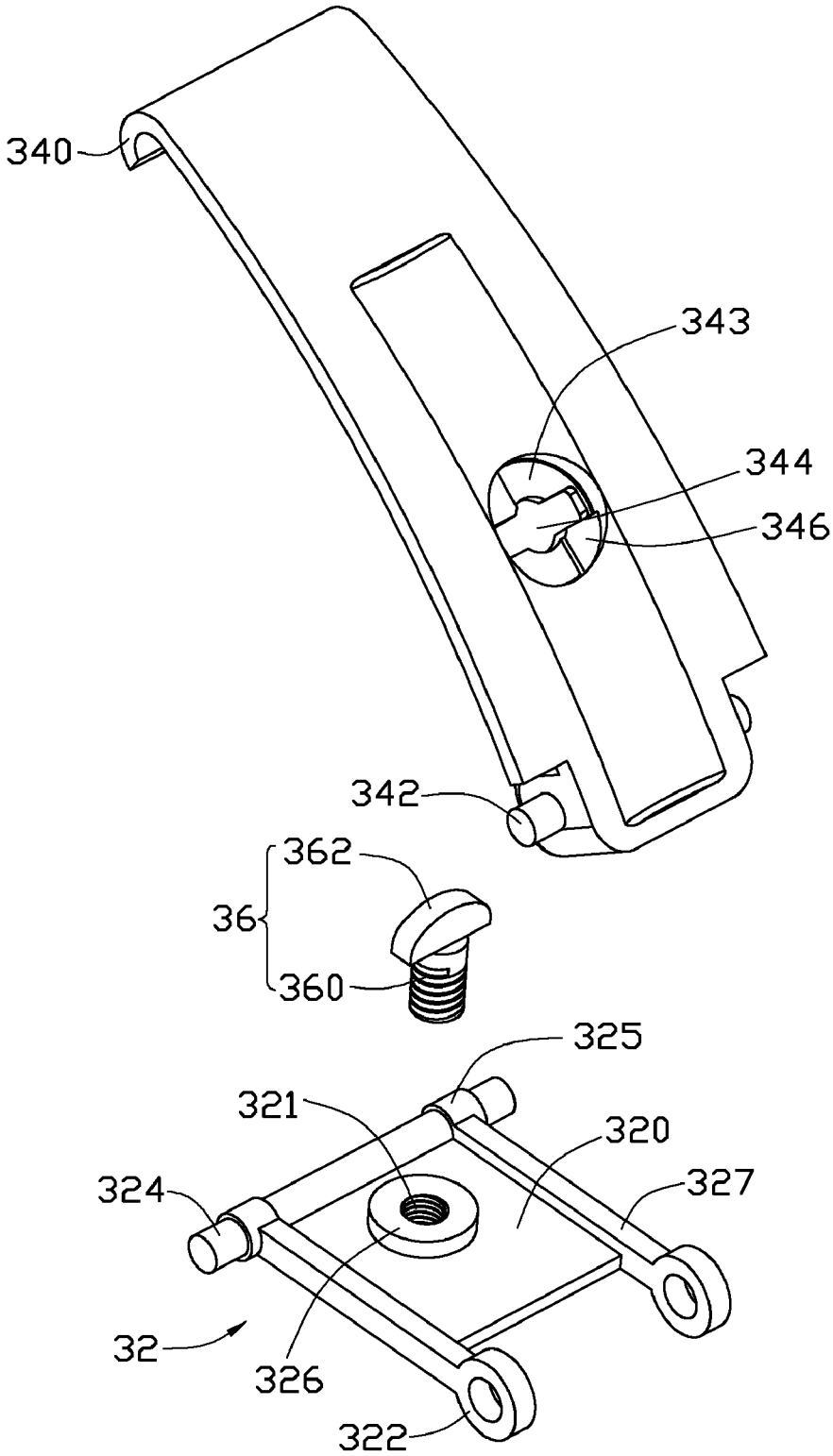
FIG. 4 is an isometric, exploded view of the buckle assembly in the unlocked position of the lamp of FIG. 3.

Referring also to FIGS. 3-4, each of the buckle assemblies 30 comprises a connecting member 32, a buckle 34 pivotally connected to an end of the connecting member 32, and a knob 36. An end of the knob 36 engages the connecting member 32. An opposite end of the knob 36 extends through the buckle 34 and then is rotated with respect to the buckle 34 to press the buckle 34 toward the lamp.

The connecting member 32 comprises a pivot plate 320 and two elongated connecting portions 327 connected with two opposite lateral sides of the pivot plate 320. Each of the connecting portions 327 has two opposite ends thereof extending beyond the pivot plate 320. The opposite ends of each of the connecting portions 327 dispose a first pivot sleeve 322 and a second pivot sleeve 325, respectively. The first pivot sleeves 322 are located at an end of the pivot plate 320, and the second pivot sleeves 325 are located at an opposite end of the pivot plate 320. A pole 324 is coupled within the second pivot sleeves 325. Two opposite end portions of the pole 324 are rotatably coupled within the cutouts 18 of corresponding buckle seats 16; thus, the connecting member 32 is pivotally connected to the buckle seats 16. A lobe 326 protrudes upwardly from the pivot plate 320. The lobe 326 defines a screw hole 321 in a center thereof. The screw hole 321 extends downwardly through the pivot plate 320.

The knob 36 comprises a screw shaft 360 and an elongated handle 362 located at an end of the screw shaft 360. The handle 362 is vertical to the screw shaft 360 and has two opposite ends thereof extending beyond the screw shaft 360. The screw shaft 360 engages into the screw hole 321 of the lobe 326.

The buckle 34 has a curved plate-shaped configuration. A hook 340 is disposed at an end of the buckle 34, and two protrusions 342 are disposed at an opposite end of the buckle 34. The protrusions 342 are rotatably coupled within the first pivot sleeves 322. The buckle 34 comprises a recess (not labeled) defined in an outer side thereof to form a step 343. The step 343 is round. A middle portion of the step 343 defines an extending hole 344 allowing extension of a top portion of the knob 36 therethrough. The extending hole 344 has a figure basically identical to and slightly larger than that of the top portion of the knob 36. Two blocks 346 protrude outwardly from the step 343. The blocks 346 are diagonally located at two opposite sides of the extending hole 344, respectively. Each of the blocks 346 is sector-like. Each of the blocks 346 has a lateral side thereof extending parallel to and along an edge of the extending hole 344.

Figure 5:
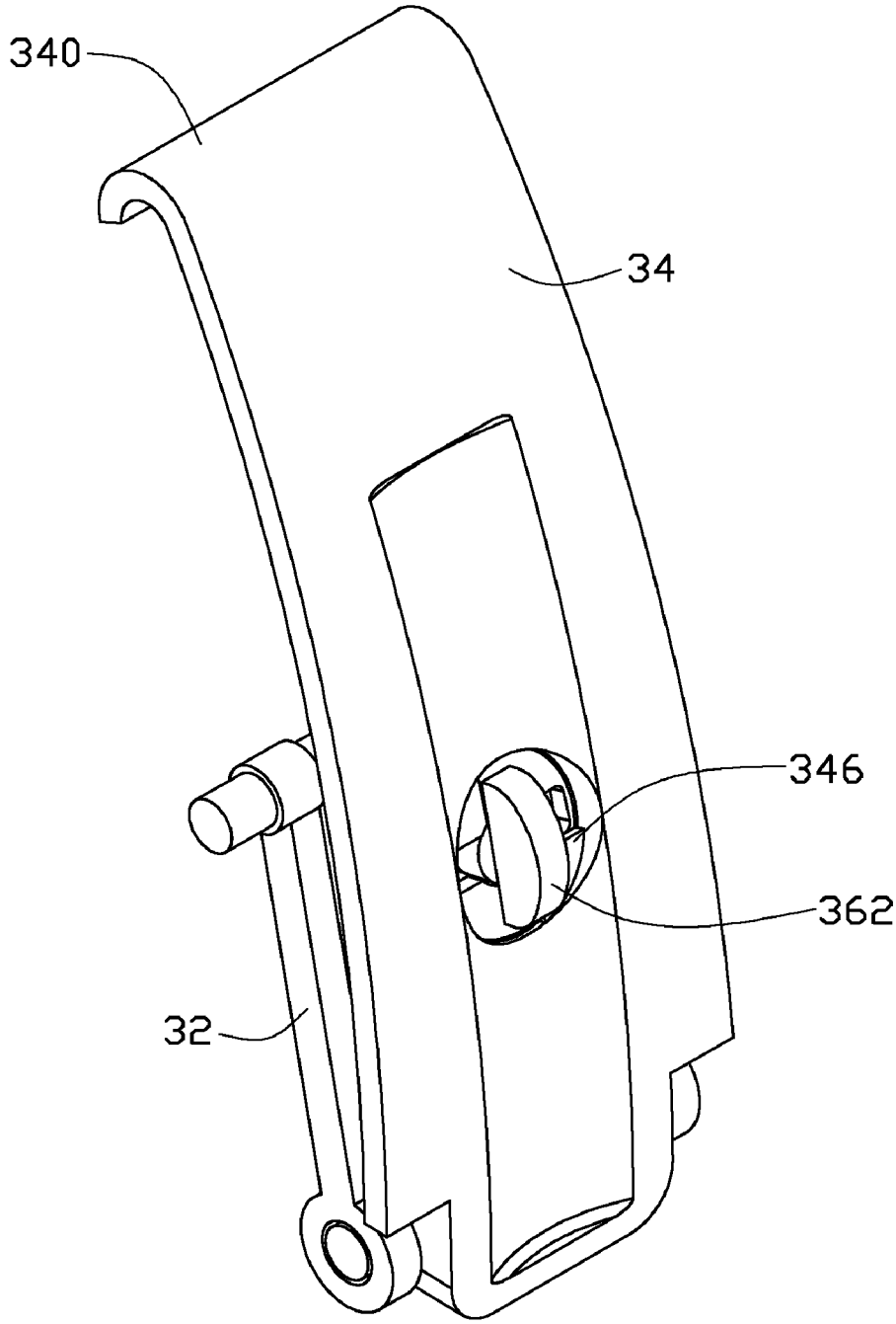
FIG. 5 is an isometric view similar to FIG. 3, but the buckle assembly is in a locked position.

Referring also to FIG. 5, after the buckle assemblies 30 are pivotally connected to the buckle seats 16, the buckle 34 is flapped towards the connecting member 32; a pivoted end between the buckle 34 and the connecting member 32 moves downwardly to be located close to the circumferential wall 22 of the second member 20. At the same time, the top portion of the knob 36 extends through the extending hole 344 beyond the step 343 of the buckle 34. Since each block 346 has the lateral side thereof extending parallel to and along an edge of the extending hole 344, the blocks 346 block the handle 362 from being rotated with respect to the step 343 along a direction towards the lateral sides of the blocks 346, that is, along a clockwise direction in this embodiment. Thus, the handle 362 is only allowed to be rotated with respect to the step 343 along a reverse direction (counterclockwise direction) which causes the screw shaft 360 of the knob 36 to be further screwed into the screw hole 321 of the lobe 326. The handle 362 is rotated with respect to the step 343 along the reverse direction until the handle 362 abuts the blocks 346 and tightly presses on the step 343. At the same time, the hook 340 clasps the circumference of the top of the first member 10 to press the first member 10 on the second member 20. Referring to FIG. 2 again, a pivoted point A between the buckle 34 and the connecting member 32 moves closer to the circumferential wall 22 of the second member 20 than a line CB connecting a pressing point C of the hook 340 and a pivoted point B between the connecting member 32 and the buckle seats 16. That is, the pivoted end between the buckle 34 and the connecting member 32 passes a dead point of the buckle assembly 30 to be adjacent to the circumferential wall 22 of the second member 20, to carry out a self-locking of the buckle assembly 30. Due to the self locking of the buckle assembly 30, the handle 362 tightly abuts the buckle 34 to prevent the pivoted end between the buckle 34 and the connecting member 32 from moving away from the circumferential wall 22 through the dead point under shock or vibration.

In this embodiment, the knob 36 engages the connecting member 32. In other embodiments, the knob 36 may engage the circumferential wall 22 of the second member 20, and when the buckle 34 is flapped towards the circumferential wall 22, the knob 36 is also able to extend through the buckle 34 to press the buckle 34 toward the circumferential wall 22.

In this embodiment, the first member 10 is flat, and the buckle assemblies 30 are mounted on the second member 20 to fasten the first member 10 on the second member 20. It is understood that the first member 10 may comprises a circumferential wall, and the buckle assemblies 30 are mounted on the circumferential wall of the first member 10 to catch the second member 20 in other embodiments.

It is believed that the disclosure and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A buckle assembly for securing a first member on a second member of a lamp, the buckle assembly comprising:

a connecting member having an end thereof pivotally connected to the second member;

a buckle having an end thereof pivotally connected to an opposite end of the connecting member and having an opposite end thereof fastening the first member on the second member; and a knob engaged with the connecting member, the knob extending through the buckle and then pressing the buckle toward the lamp after being rotated along a predetermined direction.

2. The buckle assembly of claim 1, wherein the knob comprises a screw shaft engaged with the connecting member and a handle located at an end of the screw shaft, the handle pressing the buckle toward the lamp.

3. The buckle assembly of claim 2, wherein the rotation of the knob at the predetermined direction causes the screw shaft of the knob to be screwed into the connecting member.

4. The buckle assembly of claim 2, wherein the buckle comprises an extending hole allowing extension of a top portion of the knob therethrough and two blocks diagonally located at two opposite sides of the extending hole, the handle of the knob abutting the blocks after being rotated along the predetermined direction.

5. The buckle assembly of claim 4, wherein the blocks each have a lateral side extending parallel to and along an edge of the extending hole to prevent the handle of the knob from being rotated along a direction opposite to the predetermined direction.

6. The buckle assembly of claim 2, wherein the connecting member comprises a pivot plate, the screw shaft of the knob engaging into the pivot plate.

7. The buckle assembly of claim 6, wherein the connecting member further comprises a pair of first pivot sleeves and a pair of second pivot sleeves being respectively disposed at two opposite ends of the pivot plate, two protrusions at the end of the buckle being pivotally coupled within the first pivot sleeves.

8. A lamp comprising:

a first member;

a second member; and a plurality of buckle assemblies securing the first member on the second member, each of the buckle assemblies comprising a connecting member having an end thereof pivotally connected to the second member, a buckle having an end thereof pivotally connected to an opposite end of the connecting member and having an opposite end thereof clasping the first member to the second member, and a knob engaging with the connecting member;

wherein each of the buckle assemblies has a dead point at a line extending through a connected point between the buckle and the first member and a pivoted end between the end the of buckle and the opposite end of the connecting member, when the buckle is flapped towards the connecting member and a pivoted end between the buckle and the connecting member passes through the dead point to be located nearer to the second member than the dead point, the knob extends through the buckle and then presses on the buckle after being rotated along a predetermined direction, thereby preventing the pivot end from passing through the dead point to move away from the second member.

9. The lamp of claim 8, wherein the knob comprises a screw shaft and a handle located at an end of the screw shaft, the handle pressing on the buckle.

10. The lamp of claim 9, wherein the screw shaft of the knob engages into the second member.

11. The lamp of claim 9, wherein the screw shaft of the knob engages into the connecting member.

12. The lamp of claim 11, wherein when the knob is rotated at the predetermined direction of rotation, the screw shaft of the knob is further screwed into the connecting member.

13. The lamp of claim 11, wherein the buckle comprises an extending hole allowing extension of the handle of the knob therethrough and two blocks diagonally located at two opposite sides of the extending hole, the handle of the knob abutting the blocks after being extended through the extending hole and rotated along the predetermined direction.

14. The lamp of claim 13, wherein the blocks each have a lateral side extending parallel to and along an edge of the extending hole to prevent the handle of the knob from being rotated along a direction opposite to the predetermined direction.

15. The lamp of claim 11, wherein the connecting member comprises a pivot plate, the screw shaft of the knob engaging into the pivot plate.

16. The lamp of claim 8, further comprising a light source module received in the second member, wherein light emitted from the light source module projects out of the second member through the first member.

17. The lamp of claim 8, further comprising a light source module received in the first member, wherein light emitted from the light source module projects out of the first member through the second member.

* * * * *